United States Patent [19]

Parton et al.

[11] Patent Number: 4,975,362

[45] Date of Patent: Dec. 4, 1990

[54] INFRARED SENSITIZING DYE FOR PHOTOGRAPHIC ELEMENT

[75] Inventors: Richard L. Parton, Webster; Annabel A. Muenter, Rochester; David A. Stegman, Churchville, all of N.Y.

[73] Assignee: Eastman Kodak Company, Rochester, N.J.

[21] Appl. No.: 412,380

[22] Filed: Sep. 26, 1989

[51] Int. Cl.[5] ..... G03C 1/02

[52] U.S. Cl. ..... 430/584; 430/944

[58] Field of Search ..... 430/584, 944

[56] References Cited

U.S. PATENT DOCUMENTS 2,096,842 10/1937 Brunken et al. .
2,131,853 10/1938 Dieterle et al. .
4,576,905 3/1986 Gunther et al. .
4,619,892 10/1986 Simpson et al. ..... 430/505
4,801,525 1/1989 Mihara et al. .

FOREIGN PATENT DOCUMENTS 0292322 11/1988 European Pat. Off. ..... 430/584

OTHER PUBLICATIONS

Research Disclosure No. 17363, vol. 173, Sept. 1978, Kenneth Mason, Publications, Hampshire, England.

*Primary Examiner*—Paul R. Michl
*Assistant Examiner*—Thomas R. Neville
*Attorney, Agent, or Firm*—Paul L. Marshall

[57] ABSTRACT

A photographic element is described comprising a support having thereon a silver halide emulsion layer comprising silver halide sensitized with a dye of the formula:

wherein $L_1$, $L_2$, $L_3$, $L_4$, $L_5$, $L_6$, $L_7$, $L_8$, and $L_9$ each independently represents a substituted or unsubstituted methine group, $Z_1$ represents the atoms necessary to complete a benzothiazole nucleus, a benzoxazole nucleus, a benzoselenazole nucleus, a benzotellurazole nucleus, or a benzimidazole nucleus, which, in addition to being substituted by $—SR_3$, is further substituted or unsubstituted, $Z_2$ represents the atoms necessary to complete a substituted or unsubstituted 5- or 6-membered heterocyclic ring, $R_1$ and $R_2$ each independently represents substituted or unsubstituted alkyl or substituted or unsubstituted aryl, $R_3$ represents substituted or unsubstituted alkyl of from 1 to 4 carbon atoms, m is 1 or 2, n is 0 or 1, and X is a counterion.

14 Claims, No Drawings

INFRARED SENSITIZING DYE FOR PHOTOGRAPHIC ELEMENT

FIELD OF THE INVENTION

This invention relates to photography and specifically to photographic elements having a silver halide emulsion spectrally sensitized to infrared radiation with a cyanine sensitizing dye.

BACKGROUND OF THE INVENTION

Silver halide has been widely used as a light sensitive component in photographic compositions and elements. Because silver halide is intrinsically sensitive only to blue light, it has often been desirable to impart to silver halide sensitivity to other wavelengths of radiation. This has generally been accomplished through the use of one or more spectral sensitizing dyes, such as cyanine dyes. The dye is adsorbed to the surface of the silver halide. The dye absorbs light or radiation of a certain wavelength. The energy thus absorbed by the dye is transferred to the silver halide to form a latent image exposure from which a visible image can be developed during photographic processing.

Cyanine dyes have been used to sensitize silver halide to various portions of the spectrum, such as red, green, and blue, as well as invisible radiation, such as infrared, depending on the radiation source to which a photographic element is intended to be exposed. In recent years, diode lasers that emit infrared radiation have become increasingly popular as exposure sources for a number of applications, such as for making prints from computer assisted tomography scanners, various graphic arts products that are exposed by diode lasers, and infrared sensitive false color-sensitized photographic materials as described in Simpson et al. U.S. Pat. No. 4,619,892.

While traditional infrared recording films designed for infrared radiation given off or reflected by various objects (e.g., aerial photography film for detection of vegetation growth) require fairly broad sensitivity in the region of about 700 nm to 900 nm, infrared laser diodes emit radiation at one specific wavelength, which is often longer than 800 nm and may be as deep as 850 nm or even deeper.

With the increasing popularity of infrared laser diodes emitting at specific wavelengths in the deep infrared (e.g., up to about 900 nm) as exposure sources for photographic elements, it is desirable to provide silver halide emulsions offering high peak sensitivity to infrared radiation at wavelengths where laser diodes emit.

SUMMARY OF THE INVENTION

The present invention provides a silver halide emulsion for photographic elements that is sensitized to infrared radiation with a dye having the formula:

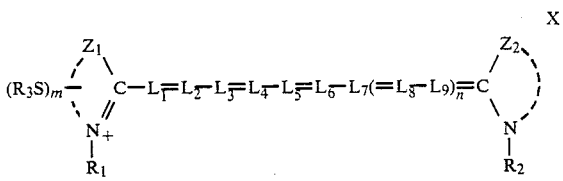

wherein $L_1$, $L_2$, $L_3$, $L_4$, $L_5$, $L_6$, $L_7$, $L_8$, and $L_9$ each independently represents a substituted or unsubstituted methine group, $Z_1$ represents the atoms necessary to complete a benzothiazole nucleus, a benzoxazole nucleus, a benzoselenazole nucleus, a benzotellurazole nucleus, or a benzimidazole nucleus, which, in addition to being substituted by $—SR_3$, is further substituted or unsubstituted, $Z_2$ represents the atoms necessary to complete a substituted or unsubstituted 5-or 6-membered heterocyclic ring, $R_1$ and $R_2$ each independently represents substituted or unsubstituted alkyl or substituted or unsubstituted aryl, $R_3$ represents substituted or unsubstituted alkyl of from 1 to 4 carbon atoms, m is 1 or 2, n is 0 or 1, and X is a counterion.

Silver halide emulsions sensitized with cyanine dyes according to formula (I) are highly sensitive to infrared radiation.

DESCRIPTION OF THE PREFERRED EMBODIMENTS

According to formula (I), $Z_1$ represents the atoms necessary to complete a benzothiazole nucleus, a benzoxazole nucleus, a benzoselenazole nucleus, or a benzimidazole nucleus. In addition to being substituted by $—SR_3$, the nucleus may be substituted with other known substituents, such as halogen (e.g., chloro, fluoro, bromo), alkoxy (e.g., methoxy, ethoxy), alkyl, aryl (e.g., phenyl) which may be appended as a substituent or fused with the nucleus, alkaryl (e.g., benzyl), aralkyl, sulfonate, and others known in the art.

Examples of nuclei useful as $Z_1$ include a substituted or unsubstituted benzothiazole nucleus (for example, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 4-phenylbenzothiazole,) etc., a substituted or unsubstituted benzoselenazole nucleus (for example, benzoselenazole, 5-chlorobenzoselenazole, 5-methoxybenzoselenazole, 5-methylbenzoselenazole, 5-hydroxybenzoselenazole,) etc., a substituted or unsubstituted benzoxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5-ethoxybenzoxazole, etc.), a substituted or unsubstituted benzotellurazole nucleus (e.g., benzotellurazole, 5-methoxybenzotellurazole, 5-methyl benzotellurazole), or a substituted or unsubstituted benzimidazole nucleus (for example, 1-methylbenzimidazole, 1-ethyl benzimidazole, 1-methyl5-chlorobenzimidazole, 1-ethyl-5-chlorobenzimidazole, 1-methyl-5-methoxybenzimidazole, 1-methyl 5-cyanobenzimidazole, 1-ethyl 5-cyanobenzimidazole, 1-methyl 5-fluorobenzimidazole, 1-ethyl 5-fluorobenz imidazole, 1-allyl 5-chlorobenzimidazole, 1-phenylbenzimidazole, 1-phenyl 5-chlorobenzimidazole, 1-methyl 5-trifluoromethylbenzimidazole, 1-ethyl 5-trifluoromethylbenzimidazole.

According to formula (I), $Z_2$represents the atoms necessary to complete a substituted or unsubstituted 5-or 6-membered heterocyclic ring. The ring may be substituted with known substituents, such as halogen (e.g., chloro, fluoro, bromo), alkoxy (e.g., methoxy, ethoxy), alkyl, aryl (e.g., phenyl) which may be appended as a substituent or fused with the heterocyclic that is $Z_2$, alkaryl (e.g., benzyl), aralkyl, sulfonate, and others known in the art.

Examples of $Z_2$ rings include a thiazole nucleus, e.g., thiazole, 4-methylthiazole, 4,-phenylthiazole, 5-methylthiazole, 5-phenylthiazole, 4,5 dimethyl thiazole, 4,5 diphenylthiazole, 4-(2 thienyl)thiazole, benzothiazole, 4-chlorobenzothiazole, 5-chlorobenzothiazole, 6-chlorobenzothiazole, 7 chlorobenzothiazole, 4-methyl benzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, naphtho[2,1-d]thiazole, naptho[1,2-d]thiazole, 5-methoxynaphtho[2,3-d]thiazole, 5-ethoxynaphtho[2,3-d]thiazole, 8-methoxynaphtho[2,3-d]thiazole, 7-methoxy-naphtho[2,3-d]thiazole, 4'-methoxythianaphtheno-7',6'4,5-thiazole, etc.; an oxazole nucleus, e.g., 4-methyloxazole, 5-methyloxazole, 4-phenyloxazole, 4,5-diphenyloxazole, 4-ethyloxazole, 4,5 -dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole 5-ethoxybenzoxazole, 5-chlorobenzoxazole, 6-methoxybenzoxazole, 5-hydroxybenzoxazole, 6-hydroxybenzoxazole,naphtho[2,1 -d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1 -d]selenazole, naphtho[1,2-d]selenazole, etc.; a thiazoline nucleus, e.g., thiazoline, 4-methylthiazoline; a pyridine nucleus, e.g, 2-pyridine, 5-methyl-2-pyridine, 4-pyridine, 3-methyl 4-pyridine, etc.; a quinoline nucleus, e.g., 2-quinoline, 3-methyl 2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, 1-isoquinoline, 3,4-dihydro-1-isoquinoline, 3-isoquinoline; a 3,3-dialkylindolenine nucleus, e.g., 3,3-dimethylindolenine, 3,3,5-trimethylindolenine; an imidazole nucleus, e.g., imidazole, 1-alkylimidazole, 1-alkyl-4-phenylimidazole, 1-alkyl-4,5-dimethylimidazole, benzimidazole, 1-alkylbenzimidazole, 1-aryl-5,6 dichlorobenzimidazole, 1-alkyl-1H-naphth[1,2 d]imidazole, 1-aryl 3H-naphth[1,2 d]imidazole, 1-alkyl-5-methoxy-1H-naphth[1,2 d]imidazole; and a tellurazole nucleus, e.g., benzotellurazole, naphtho[1,2 d]tellurazole 5,6-dimethoxytellurazole, 5-methoxytellurazole, 5-methyltellurazole.

$L_1$, $L_2$, $L_3$, $L_4$, $L_5$, $L_6$, $L_7$, $L_8$, and $L_9$ each independently represents a substituted or unsubstituted methine group. Examples of substituents for $L_1$-$L_9$ include alkyl (preferably of from 1 to 6-carbon atoms, e.g, methyl, ethyl, etc.) and aryl (e.g., phenyl). Additionally, substituents on the methine groups may form bridged linkages. For example, when n is 0: $L_2$ and $L_4$, or $L_4$ and $L_6$ may be bridged to form a 6-membered substituted or unsubstituted carbocyclic ring. $L_3$ and $L_5$ may be bridged to form a 6-membered substituted or unsubstituted carbocyclic ring, with $L_4$ preferably substituted with alkyl or aryl. $L_3$ and $L_5$ may be bridged to form a 5-membered substituted or unsubstituted carbocyclic ring where $L_4$ is preferably substituted with a nitrogen-containing heterocyclic ring. $L_2$, $L_4$, and $L_6$ may be bridged to form a 10-membered fused substituted or unsubstituted carbocyclic ring, or $L_1$and $L_7$ may, together with $R_1$ and $R_2$, respectively, form a 5-or 6-membered ring structure. When n is 1: $L_2$ and $L_4$, or $L_6$ and $L_8$, may be bridged to form a 6-membered substituted or unsubstituted carbocyclic ring. $L_1$ and $L_9$ may, together with $R_1$ and $R_2$, respectively, form a 5-or 6-membered ring structure.

$R_1$ and $R_2$ each independently represents substituted or unsubstituted alkyl, preferably of from 1 to 8 carbon atoms (e.g., methyl, ethyl, propyl, and the like), or substituted or unsubstituted aryl, preferably of from 6 to 20 carbon atoms (e.g., phenyl, tolyl). $R_1$ and $R_2$ may each be substituted with any of a number of known substituents, such as sulfo, carboxy, cyano, halogen (e.g., fluoro, chloro), hydroxy, alkenyl (e.g., allyl, 2 carboxyallyl), alkoxy (e.g., methoxy, ethoxy), aryl (e.g., phenyl, p sulfophenyl), aryloxy (e.g , phenyloxy), carboxylate (e.g., methoxy:arbonyl, ethoxycarbonyl), acyloxy (e g., acetyloxy), acyl (e.g., acetyl, propionyl), and others known to those skilled in the art. X represents a counterion as necessary to balance the charge of the dye molecule The counterion may be ionically complexed to the molecule or it may be part of the dye molecule itself to form an intramolecular salt. Such counterions are well-known in the art. For example, when X is an anion (e.g., when $R_1$ and $R_2$ are unsubstituted alkyl), examples of X include chloride, bromide, iodide, p-toluene sulfonate, methane sulfonate, methyl sulfate, ethyl sulfate, perchlorate and the like. When X is a cation (e.g., when $R_1$ and $R_2$ are both sulfoalkyl or carboxyalkyl), examples of X include sodium, potassium, triethylammonium, and the like.

In a preferred embodiment, the dyes used in the invention are chosen according to formula:

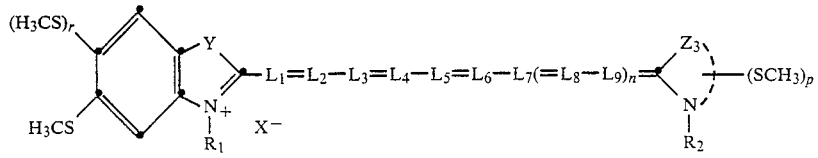

wherein p is 0, 1, or 2, r is 0 or 1,

Y represents S, 0, or Se, $Z_3$ represents the atoms necessary to complete a benzothiazole nucleus, benzoxazole nucleus, benzotellurazole nucleus, or benzoselenazole nucleus if p is 1 or 2, and which may be further substituted if p is 1, or the atoms necessary to complete a substituted or unsubstituted: thiazole nucleus, thiazoline nucleus, oxazole nucleus, selenazole nucleus, quinoline nucleus, tellurazole nucleus, or pyridine nucleus if p is 0, and $R_1$, $R_2$, $L_1$-$L_9$, and n are as defined above.

Examples of dyes according to formulas (I) and (II) are set forth in Tables I-VII below, where Sp represents 3-sulfopropyl, Ph represents phenyl, Me represents methyl, and Et represents ethyl.

TABLE I

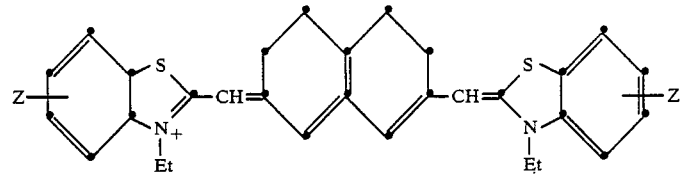

| Dye | Z |
|---|---|
| 1 | 5,6-SMe |
| 2 | 5-SMe |

TABLE II

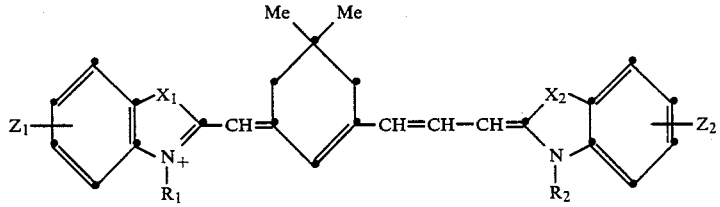

| Dye | $X_1$ | $X_2$ | $R_1$ | $R_2$ | $Z_1$ | $Z_2$ |
|---|---|---|---|---|---|---|
| 3 | S | O | Et | Et | 5,6-SMe | 5-CH=CHPh |
| 4 | S | O | Sp | Sp | 5,6-SMe | 5-Ph |
| 5 | S | O | Et | Sp | 5,6-SMe | 5-Ph |
| 6 | S | O | Et | Et | 5,6-SMe | 5,6-Benzo |
| 7 | S | O | Et | Et | 5,6-SMe | 4,5-Benzo |
| 8 | S | O | Et | Et | 5,6-SMe | 5-Ph |
| 9 | S | S | Et | Et | 5,6-SMe | 5-OMe, 6-Me |
| 10 | S | O | Et | Et | 5,6-SMe | H |
| 11 | S | S | Sp | Et | 5,6-SMe | 4,5-Benzo |
| 12 | S | S | Et | Et | 5,6-SMe | 5,6-SMe |
| 13 | S | CH=CH | Et | Et | 5,6-SMe | H |
| 14 | S | S | Et | Et | 5,6-SMe | 4,5-Benzo |
| 15 | S | S | Et | Me | 5-SMe | H |

TABLE III

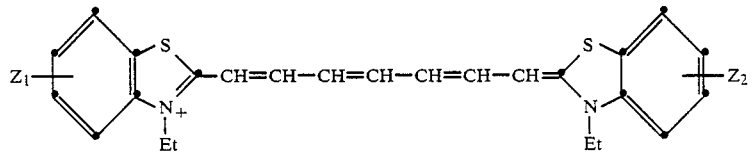

| Dye | $Z_1$ | $Z_2$ |
|---|---|---|
| 16 | 5,6-SMe | 4,5-Benzo |
| 17 | 5,6-SMe | 5,6-SMe |

TABLE IV

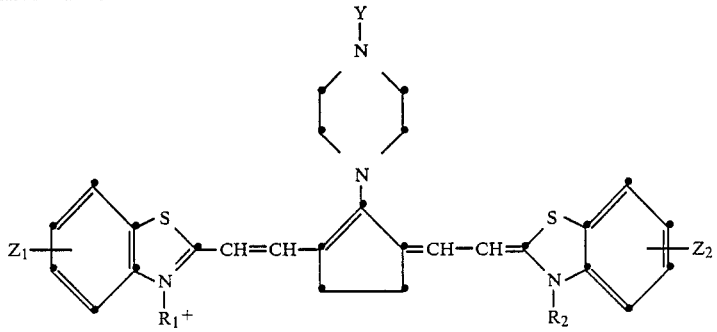

| Dye | $R_1$ | $R_2$ | $Z_1$ | $Z_2$ | Y |
|---|---|---|---|---|---|
| 18 | Et | Et | 5,6-SMe | 5,6-SMe | $CO_2Et$ |
| 19 | Et | Et | 5-SMe | 5-SMe | $CO_2Et$ |
| 20 | Sp | Sp | 5-SMe | 5-SMe | $SO_2N(Me)_2$ |
| 21 | Sp | Sp | 5-SMe | 5-SMe | $CO_2Et$ |

22

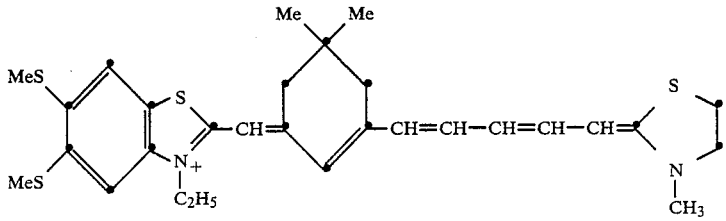

23

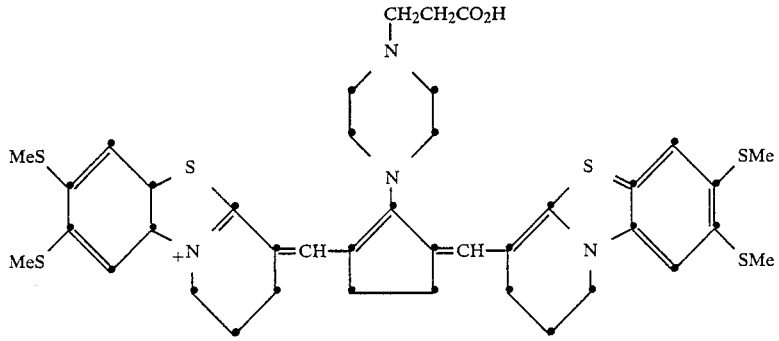

TABLE V

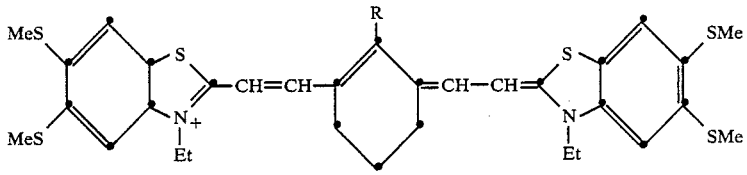

| Dye | R |
|---|---|
| 24 | Ph |
| 25 | Me |

Tricarbocyanine and tetracarbocyanine dyes and their methods of synthesis are well-known in the art. Synthetic techniques for these known dyes, such as described in U.S. Pat. No. 2,734,900 or Hamer, Cyanine Dyes and Related Compounds, John Wiley & Sons, 1964, Synthesis of the dyes of formula (I) is within the level of skill in the art.

The dyes of formula (I) are advantageously used to sensitize photographic silver halide emulsions to infrared radiation and can, in many instances, provide good performance with regard to fog and stability on keeping. These silver halide emulsions can contain grains of any of the known silver halides, such as silver bromide, silver chloride, silver bromoiodide, and the like, or mixtures thereof, as described in *Research Disclosure.* Item 17643 December 1978 [hereinafter referred to as *Research Disclosure*], Section I The silver halide grains may be of any known type, such as spherical, cubic, or tabular grains, as described in *Research Disclosure I.* Section I or *Research Disclosure,* Item 22534, January, 1983.

The silver halide emulsions generally include a hydrophilic vehicle for coating the emulsion as a layer of a photographic element. Useful vehicles include both naturally occurring substances such as proteins, protein derivatives, cellulose derivatives (e.g., cellulose esters), gelatin (e.g., alkali treated gelatin such as cattle bone or hide gelatin, or acid treated gelatin such as pigskin gelatin), gelatin derivatives (e.g., acetylated gelatin phthalated gelatin and the like), and others described in *Research Disclosure I.* Also useful as vehicles or vehicle extenders are hydrophilic water permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates polyamides, polyvinyl pyridine, methacrylamide copolymers, and the like, as described in *Research Disclosure I.* The vehicle can be present in the emulsion in any amount known to be useful in photographic emulsions In a preferred embodiment, the silver halide emulsion sensitized with a dye of formula (I) also contains a bis azine compound. The bis azines useful in the invention are well known in the art (usually as supersensitizers for red or infrared sensitive silver halide emulsions). They include those according to the formula.

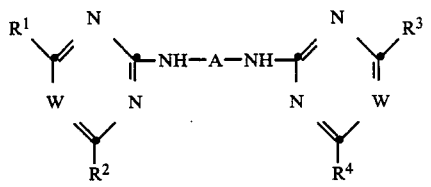

(III)

According to formula (III), W represents nitrogen or —$CR^5$=where $R^5$ is hydrogen, halogen (e.g., chloro, bromo, etc.), or alkyl (preferably of from 1 to 4 carbon atoms, e.g., methyl, ethyl, etc.). $R_1$, $R_2$, $R_3$, and $R_4$each independently represents hydrogen, hydroxy, alkoxy (preferably having from 1 to 10 carbon atoms, e.g., methoxy, ethoxy, propoxy, etc.), alkyl (preferably having from 1 to 10 carbon atOms, e.g., methyl, ethyl, n-butyl, isopropyl, etc.), an aryloxy group (e.g., phenoxy, o-tolyloxy, p-sulfophenoxy, etc.), a halogen atom (e.g., chlorine, bromine, etc.), a heterocyclic nucleus (e.g., morpholinyl, piperidyl, etc.), an alkylthio group (wherein the alkyl moiety preferably has from 1 to 10 carbon atoms, e.g., methylthio, ethylthio, etc.), a heterocyclothio group (e.g., benzothiazolylthio, etc.), an arylthio group (e.g., phenylthio, tolylthio, etc.), an amino group, an alkylamino group, which term includes an unsubstituted and a substituted alkylamino group such as a hydroxy or sulfo substituted alkylamino group (preferably an alkylamino group or substituted alkylamino group wherein the alkyl moiety has from 1 to 10 carbon atoms, e.g., methylamino, ethylamino, propylamino, dimethylamino, diethylamino, dodecylamino, cyclohexylamino, β-hydroxyethylamino, di-(β-hydroxyethyl)amino, β-sulfoethylamino, etc.), an arylamino group, which term includes an unsubstituted arylamino group and a substituted arylamino group, preferably a substituted arylamino group wherein the substituent is an alkyl group of from about 1 to 4-carbon atoms, a sulfo group, a carboxy group, a hydroxy group, and the like (e.g., anilino, o-sulfoanilino, m sulfoanilino, p-sulfoanilino, o-anisylamino, m-anisylamino, p-anisylamino, o-toluidino, m toluidino, p-toluidino, o-carboxyanilino, m-carboxyanilino, p-carboxyanilino, hydroxyanilino, disulfophenylamino, naphthylamino, sulfonaphthylamino, etc.), a heterocycloamino group (e.g., 2-benzothiazolylamino, 2-pyridyl amino, etc.), an aryl group (e.g., phenyl, etc.), or a mercapto group, where $R^1$, $R^2$, $R^3$ and $R^4$ may each be the same as or different from one another.

Also according to formula (III), A represents a divalent aromatic residue, preferably comprising 1 to 4-aromatic rings. Such residues are known in the art and are described, for example, in U.S. Pat. No. 4,199,360, the disclosure of which is incorporated herein by reference. Examples of such divalent aromatic residues include:

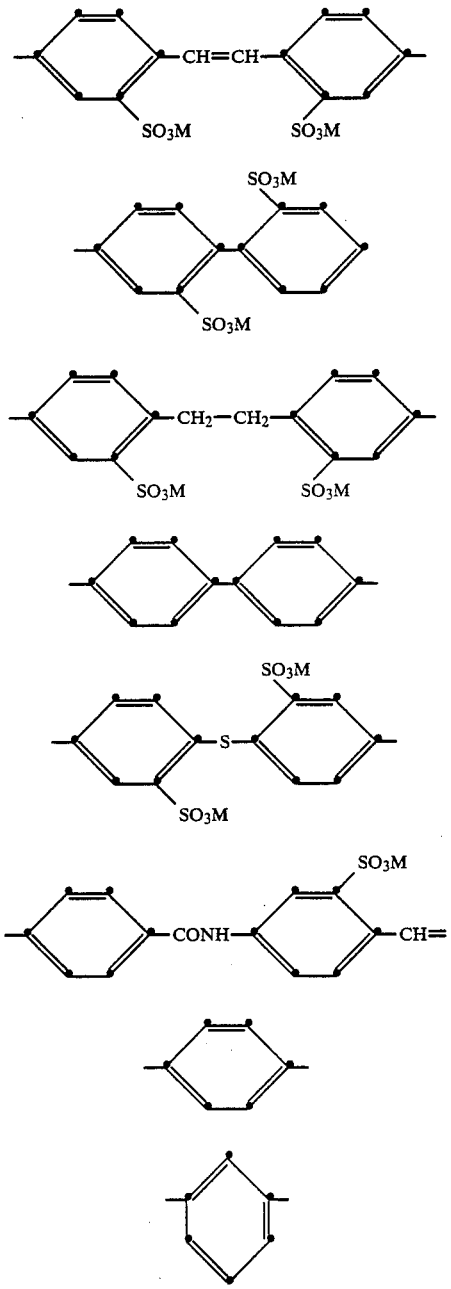

-continued
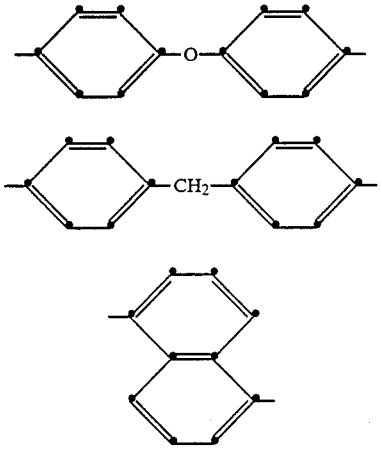
where M represents hydrogen or a cation (preferably an alkali metal, e.g., sodium, potassium, etc. or an ammonium group).
In a preferred embodiment, the divalent aromatic residue represented by A is a stilbene. One such stilbene is represented by the formula:
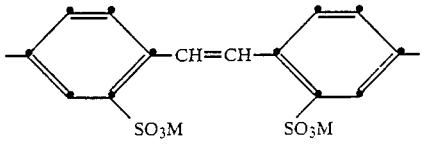
Specific examples of bis-azine compounds according to formula (III) include:
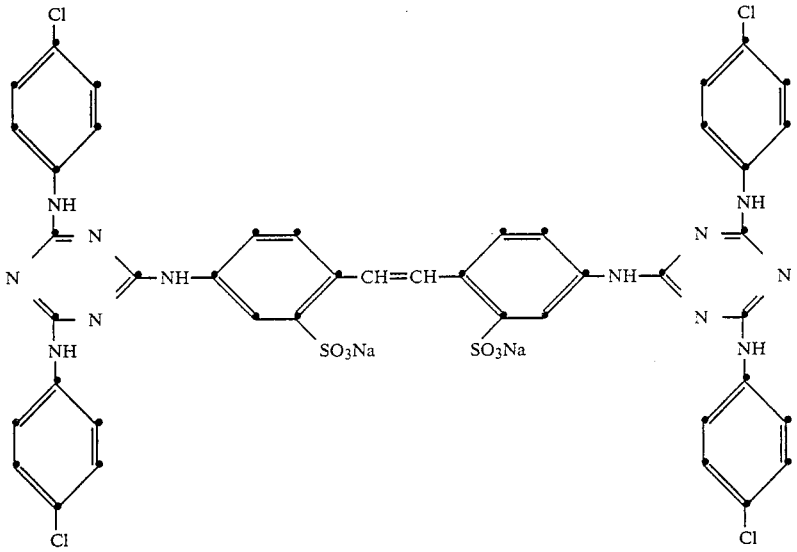
T-1
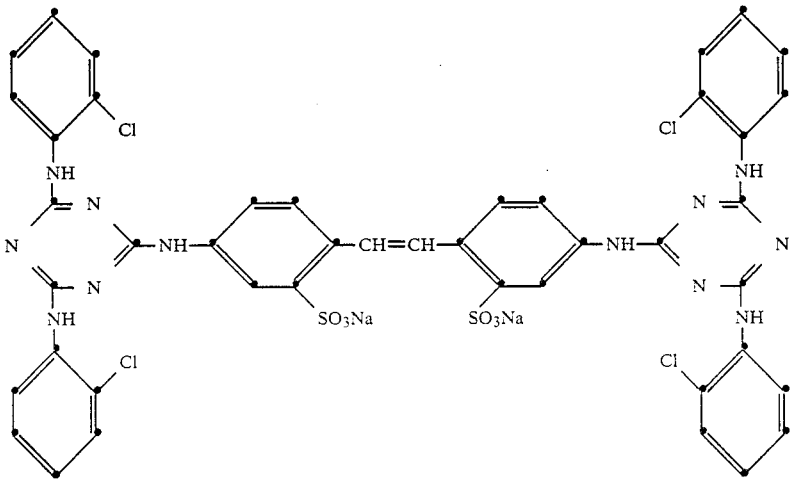
T-2

-continued

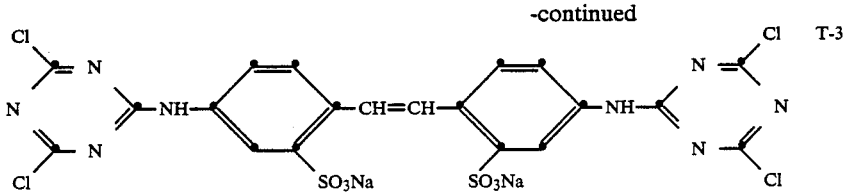

T-3

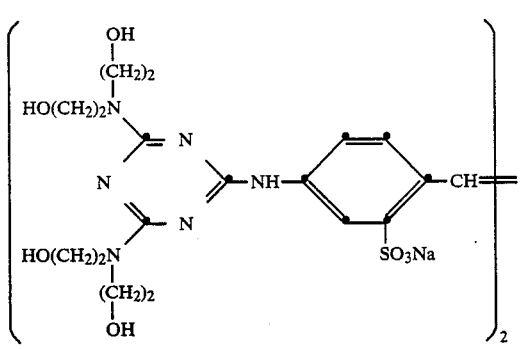

T-4

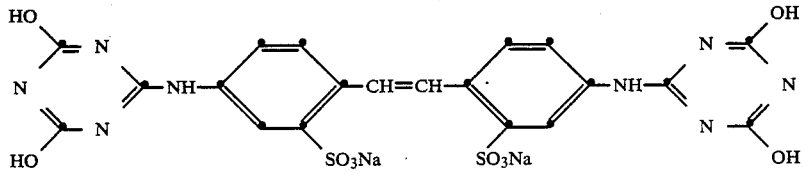

T-5

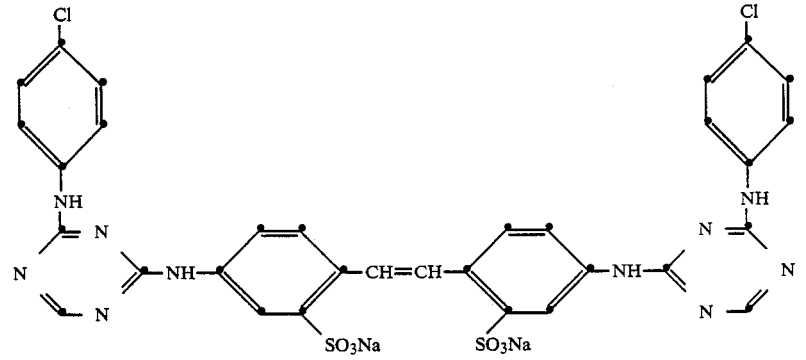

T-6

The optimum amount of the bis-azine compound will vary with factors such as the performance criteria of the photographic element, the processing conditions to be used, the type of emulsion, and the particular sensitizing dye. The bis-azine can be added to the emulsion melt or in other phases of silver halide emulsion preparation, such as during chemical sensitization. Useful amounts of the bis-azine compound preferably include from about 0.1 to about 100 moles per mole of sensitizing dye, although smaller amounts may also be useful depending on factors such as those identified above. Mixtures of different bis azines can also be used.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure* , June, 1975, item 13452 and U.S Pat. No. 3,772,031.

Other addenda include brighteners, antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein.

The emulsion layer containing silver halide sensitized with the dye of the invention can be coated simultaneously or sequentially with other emulsionlayers, subbing layers, filter dye layers, or interlayers or overcoat layers, all which may contain various addenda known to be included in photographic elements. These include antifoggants, oxidized developer scavengers, DIR couplers, antistatic agents, optical brighteners, light-absorbing or light scattering pigments, and the like.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

The photographic element of the invention can be black and white or color. Since the photographic element of the invention is sensitive to infrared radiation, which is invisible to the human eye, a color element would be a false color sensitized element, with one or more infrared-sensitive layers having one or more dye-forming couplers associated therewith. Such an element is described, for example, in U.S. Pat. No. 4,619,892. Color dye forming couplers and the various addenda associated therewith are well-known in the art and are described, for example, in *Research Disclosure I*, Section VII, and the references cited therein.

The invention is further described in the following examples.

EXAMPLE 1 Preparation of Dye 14

Step A—Preparation of 2-Methyl-5,6-dimethyl thiobenzothiazole

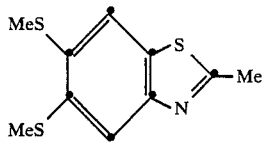

2-amino-5-methythio-6-thiocyanatobenzothiazole was prepared by dissolving freshly distilled 3-methylmercaptoaniline (139 g, 1.0 mol) in 5 L of methanol, and sodium thiocyanate (404 g, 5.0 mol) was added The mixture was chilled in ice, stirred, and bromine (130 mL, 2.52 mol) was added dropwise over a three hour period. After addition was complete, the mixture was stirred for 1 hr at room temperature, the product was collected, washed with water and dried (220 g, 86.9% yield).

2,4,5-Trimethylthioaniline was prepared by combining 2-amino-5-methylthio-6-thiocyanatobenzothiazole (220 g, 0.87 mol) with 1.2 L of water, 1.0 L of 50% sodium hydroxide solution, and sodium borohydride (40 g, 1.06 mol) in a 5 L, 3-necked flask. The mixture was stirred with a mechanical stirrer and refluxed under a nitrogen atmosphere for 15 hr. The mixture was cooled to room temperature and ethanol (800 mL) was added followed by addition of iodomethane (300 g, 2.11 mole). The solution was collected and dried. The product was recrystallized from ethanol (66 g, 33% yield).

N-Acetyl 2,4,5 trimethylthioaniline was prepared by dissolving 2,4,5 trimethylthioaniline (33 g, 0.143 mol) in 200 mL of acetic anhydride at room temperature. Ligroin (800 mL) was added and the mixture was stirred and cooled until the product precipitated. The solid was collected and dried (24 g, 62% yield), mp 87-89° C.

2-Methyl-5,6-dimethylthiobenzothiazole was prepared by combining N-acetyl-2,4,5-trimethylthioaniline (20 g , 0.073 mol) and phosphoryl chloride (40 mL) and heating the mixture on a steam bath for 10 min. During this time the reaction mixture solidified. The solid was collected, washed with ether and dried, affording 27 g of the hydrochloride salt. The free base was prepared by dissolving the salt in a mixture of 300 mL of ether and 300 mL of methanol and adding 35 mL of triethylamine. The solvents were evaporated, the solid was collected, slurried with distilled water, collected, and washed with warm water and dried (16 g, 91% yield), mp 79-81° C.

Step B—Preparation of 3-Ethyl-2-methyl-5, 6-dimethylthiobenzothiazolium p-toluenesulfonate

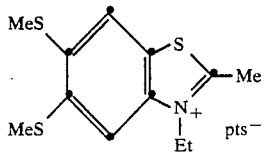

5,6-Dimethylthio-2-methylbenzothiazole (35 g, 0.145 mol) and ethyl p-toluenesulfonate (35 g, 0.18 mol) were combined in 400 mL of butyronitrile and heated at reflux overnight. The solid formed was collected and washed with ether (30 g, 48% yield).

Step C—Preparation of 3 Ethyl 5,6-dimethylthio-2-(3,5,5,-trimethyl-2-cyclohexenylidine)methyl benzothiazolium tetrafluoroborate

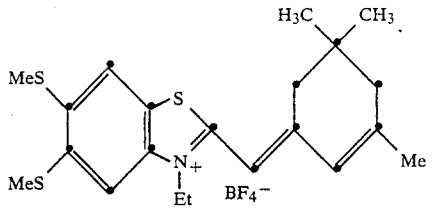

3-Ethyl-2-methyl-5,6--dimethylthiobenzothiazolium p-toluenesulfonate (4.2 g, 10 mmol), isophorone (5.5 g, 40 mmol), ammonium acetate (2.7 g, 35 mmol), and acetic acid (10 mL) were combined in 100 mL of toluene and refluxed for 1 hr with a Dean-Stark trap during which time 3 mL of water were collected. The reaction mixture was cooled and the solvent was removed under vacuum at 50° C. Water (100 mL) and sodium tetrafluoroborate (excess) were added with stirring. The product oiled out of solution and isopropyl alcohol was added until the oil re-dissolved After stirring 2 hours the product had crystallized out. It was collected, recrystallized form 50 mL of acetic acid, collected and dried (3.2 g, 71% yield).

Step D—Preparation of 1,3'-diethyl-5',6'-dimethylthio-9,11-neopentylene-naphtho{1,2-d}thiazolotricarbocyanine tetrafluoroborate, (Dye 14)

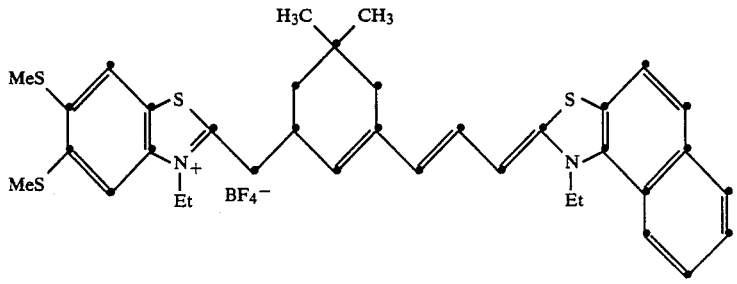

3-Ethyl-5,6-dimethylthio-2-(3 5 5-trimethyl-2-cyclohexenylidine)-methyl benzothiazolium tetrafluoroborate (1.0 g, 2.2 mmol) 2-(2-anilinovinyl)1-ethylnaphtho{1,2-d]}thiazolium p-toluenesulfonate (1.0 g, 2.0 mmol) and triethylamine (1.0 g, 10 mmol) were combined in 20 mL of dry acetonitrile and heated at reflux for 2 min. The reaction mixture was cooled and the product was collected and recrystallized from 20 mL of pyridine This afforded 0.9 g (64% yield) of dye, $\lambda_{max}=801nm(MeOH), \epsilon_{max}=21.16\times10^4$ EXAMPLE 2—Preparation of 3,3'-diethyl5,5',6,6'-tetramethylthiobenzothiazolotricarbocyanine tetrafluoroborate (Dye 17)

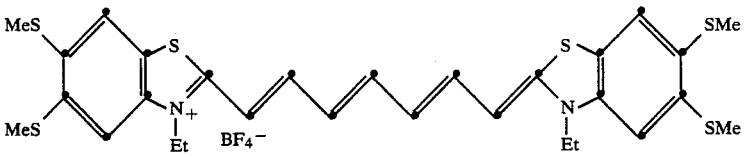

3 Ethyl 2 methyl 5,6 dimethylthiobenzothiazolium p-toluenesulfonate 2.0 g, 5 mmol), glutacondialdehyde dianil hydrochloride (0.72 g, 2.5 mmol) and triethylamine (5 mL) were combined in 20 mL of pyridine and heated at reflux for 2 min. The reaction mixture was cooled and the product was collected and dissolved in methanol. Tetrabutylammonium tetrafluoroborate (0.82 g, 2.5 mmol) was added and the solid that precipitated was collected, washed with methanol, and dried. This afforded 0.75 g (44% yield) of dye $\lambda_{max}=797nm(MeOH), \epsilon_{max}=23.97\times10^4.$ EXAMPLE 3—Preparation of 11-(4-ethoxycarbonyl-1-piperazinyl)-3,3'diethyl-10,12-ethylene-5,5=,6,6'-tetramethylthiobenzothiazoloticarbocyanine tetrafluoroborate salt (Dye 18)

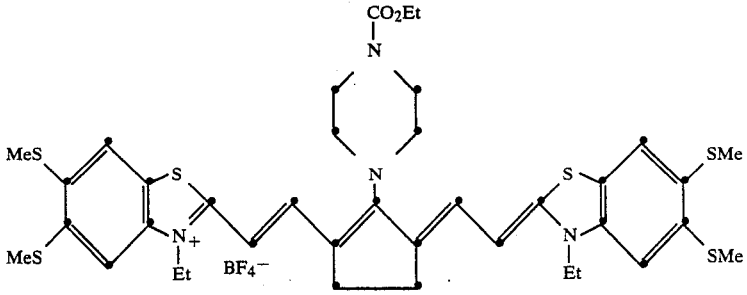

3-Ethyl-5,6-dimethylthiobenzothiazolium p-toluenesulfonate (1.54 g, 4 mmol) and 1[2,5-bis-(anilinomethylene)cyclopentylidene]-4-ethoxycarbonylpiperazinium tetrafluoroborate (1.0 g, 2 mmol) were combined in 11 ML of acetic anhydride with triethylamine (1 mL) and heated at reflux for 5 min. Upon cooling, the product crystallized out. It was collected, washed with acetic anhydride, and dried (0.2 g, 12% yield), λ-max=760 nm (MeCN), $\epsilon max=16.0\times10^4$.

EXAMPLE 4

Photographic evaluation was carried out in the following photographic element, coated on polyethylene coated paper support which had been previously overcoated with a layer containing 10.8 mg gelatin/dm2: The imaging layer contained a sulfur plus gold sensitized pure silver chloride emulsion (0.35 λm), coated at 1.8 mg Ag/dm2, gelatin at 16.6 mg/dm2, and cyan-forming coupler (structure A) at 4.5 mg/dm2 The emulsion was doctored with 500 mg/mole Ag of the supersensitizer (structure T 2), 450 mg/mole Ag of the antifoggant 1-(3-acetamidophenyl)-5-mercapto-tetrazole sodium salt, and 1 mole percent of potassium bromide. Dyes according to the invention or comparison dyes (designated by the letter "C") were added to the emulsion at 0.03 millimoles/mole Ag unless otherwise specified. The imaging layer was simultaneously overcoated with a layer containing 10.8 mg gelatin/dm2.

To determine the degree of desensitization by the dyes, the coatings were exposed for 0.2 sec to the 365 line emission of a mercury arc lamp filtered through a Kodak Wratten ®filter number 18A and a step wedge ranging in density from 0 to 3 density units in 0.15 density steps. Speed at a density of 1.0 was compared to the speed of a similarly exposed undyed control coating. The difference in speed, labelled Δ365 line, gives the desensitization. Processing was done through a standard Kodak EP-2 process.

To determine the wavelength of maximum spectral sensitization, λmax, the coatings were given 1 or 4 sec exposures on a wedge spectrographic instrument which covers the wavelength range from 400 to 850 nm. The instrument contains a tungsten light source and a step tablet ranging in density from 0 to 3 density units in 0.3 density steps. After processing through a standard Kodak EP-2 ®process, speed is read at 10 nm wavelength intervals at a density of 0.9 above fog. Correction for the instrument's variation in spectral irradiance with wavelength is done via computer and the wavelength of maximum spectral sensitivity is read from the resulting plot of log sensitivity vs. wavelength. The sensitivity at λ-max is reported in Tables VIII–XI as log relative sensitivity.

Structure A

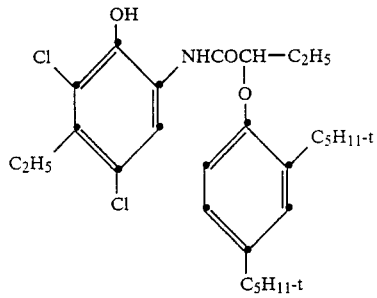

TABLE VIII

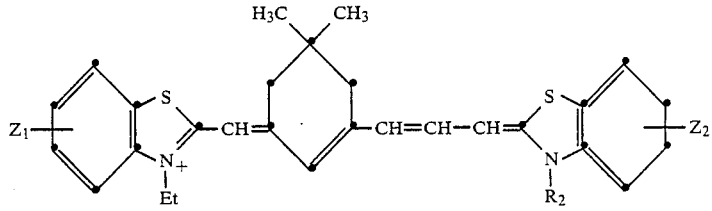

| Dye | $Z_1$ | $Z_2$ | $R_2$ | λ-max | Δ365l | Log Relative Sensitivity |
|---|---|---|---|---|---|---|
| 15 | 5-Sme | H | Me | 820 | −0.17 | 1.63 |
| 15* | 5-Sme | H | Me | 820 | −0.32 | 1.10 |
| C-1 | 5-OMe | H | Me | 820 | −0.34 | 1.43 |
| C-1* | 5-OMe | H | Me | 820 | −0.48 | 0.90 |
| 14 | 5,6-SMe | 4,5-Benzo | Et | 855 | −0.48 | 1.46 |
| C-2 | 5,6-OMe | 4,5-Benzo | Et | 840 | −0.60 | 1.28 |
| 12 | 5,6-SMe | 5,6-SMe | Et | 855 | −0.41 | 1.54 |

*0.06 mmole/mole Ag

TABLE IX

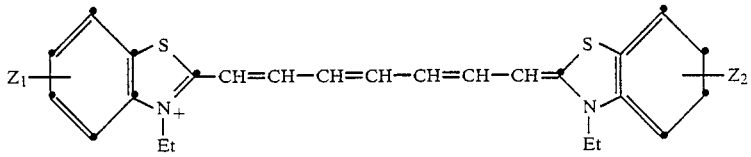

| Dye | $Z_1$ | $Z_2$ | λ-max | Δ365l | Log Relative Sensitivity |
|---|---|---|---|---|---|
| 16 | 5,6-SMe | 4,5-Benzo | 855 | −0.37 | 1.32 |
| C-3 | 5,6-OMe | 4,5-Benzo | 855 | −0.60 | 1.20 |
| C-4 | 5,6-H | 4,5-Benzo | 860 | −0.61 | 1.09 |
| 17 | 5,6-SMe | 5,6-SMe | 860 | −0.40 | 1.28 |
| C-5 | 5,6-OMe | 5,6-OMe | 840 | −0.30 | .83 |

TABLE X

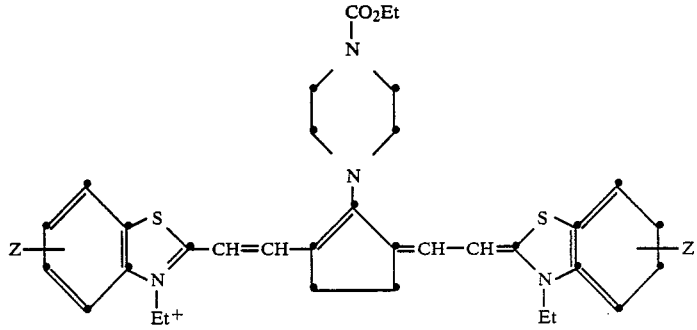

| Dye | Z | λ-max | Δ3651 | Log Relative Sensitivity |
|---|---|---|---|---|
| 18 | 5,6-SMe | 810 | −0.44 | 1.64 |
| C-6 | 5,6-H | 790 | −0.39 | 1.73 |
| C-7 | 4,5-Benzo | 840 | −0.72 | 1.00 |

TABLE XI

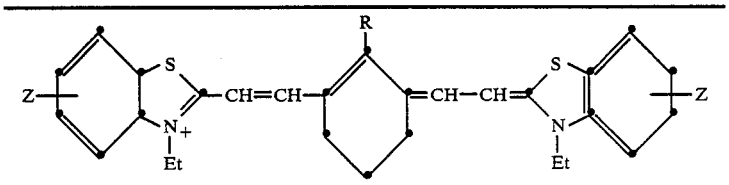

| Dye | R | Z | λ-max | Δ3651 | Log Relative Sensitivity |
|---|---|---|---|---|---|
| 24 | $C_6H_5$ | 5,6-SMe | 860 | −0.46 | 1.42 |
| C-8 | $C_6H_5$ | 4,5-Benzo | 865 | −0.61 | 0.71 |
| C-9 | $C_6H_5$ | H | 835 | −0.51 | 1.10 |

The data presented above indicate that, when examined in relation to the comparison dyes, the dyes according to formula (I) provide silver halide emulsions with greater sensitivity at comparable wavelengths, or similar (or greater) sensitivity at deeper wavelengths. The dyes according to formula (I) also cause less desensitization in the region of intrinsic sensitivity of silver halide.

EXAMPLE 6

Elements were prepared as in Example 5, except using as the sensitizing dyes, Dye 22 according to the invention and comparison dye C-2 shown below, at a concentration of 0.03 mmole/mole Ag. The wavelength of maximum sensitivity was determined using a series of 2 sec exposures from a 2850 K tungsten lamp, filtered through interference filters ranging in wavelength from 850 to 900 nm in 10 nm increments and a step wedge ranging in density from 0 to 3 density units in 0.15 density steps. After processing through a standard Kodak EP-2 process, speeds were read at a density of 1.0. After correction for the variation in spectral irradiance through the filters, a plot of spectral sensitivity vs wavelength was made and used to determine the wavelength of maximum spectral sensitivity. The monochromatic speeds are shown in Table XII.

C-10

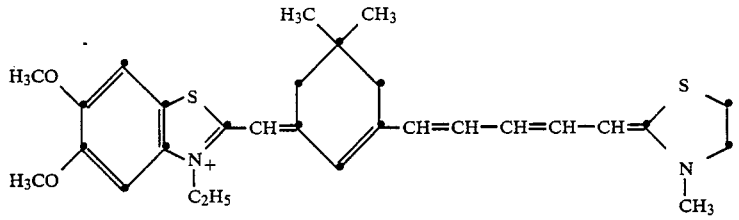

TABLE XII

| | Log Relative Sensitivity at | | | |
|---|---|---|---|---|
| | 870 nm | 880 nm | 890 nm | 900 nm |
| Dye 22 | 1.32 | 1.29 | 1.30 | 1.11 |
| Dye C-10 | 1.31 | 1.19 | 1.17 | 0.94 |

The data in Table XII show that dye 22 provides silver halide emulsions with greater sensitivity at deeper wavelengths than the comparison dye.

The invention has been described in detail with particular reference to preferred embodiments thereof, but it will be understood that variations and modifications can be effected within the spirit and scope of the invention.

What is claimed is:

1. A photographic element comprising a support having thereon a silver halide emulsion layer comprising silver halide sensitized with a dye of the formula:

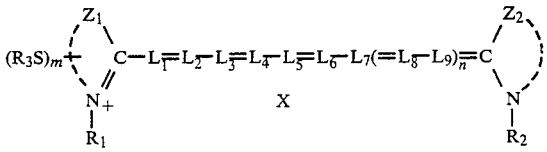

where $L_1$, $L_2$, $L_3$, $L_4$, $L_5$, $L_6$, $L_7$, $L_8$, and $L_9$ each independently represents a substituted or unsubstituted methine group, $Z_1$ represents the atoms necessary to complete a benzothiazole nucleus, a benzoxazole nucleus, a benzoselenazole nucleus, a benzotellurazole nucleus, or a benzimidazole nucleus, which, in addition to being substituted by —$SR_3$, is further substituted or unsubstituted, $Z_2$ represents the atoms necessary to complete a substituted or unsubstituted 5- or 6-membered heterocyclic ring, $R^1$ and $R^2$ each independently represents substituted or unsubstituted alkyl, or substituted or unsubstituted aryl, $R^3$ represents substituted or unsubstituted alkyl of from 1 to 4 carbon atoms, m is 1 or 2, n is 0 or 1, and X is a counterion.

2. A photographic element according to claim 1 wherein $R^3$ represents alkyl of from 1 to 2 carbon atoms.

3. A photographic element according to claim 1 wherein $R_3$ is methyl.

4. A photographic element according to any of claims 1–3 wherein n is 0.

5. A photographic element according to claim 4 wherein m is 2.

6. A photographic element according to any of claims 1–3 wherein m is 2.

7. A photographic element according to any of claims 1–3 wherein $Z_1$ represents the atoms necessary to complete a benzothiazole nucleus, which, in addition to being substituted by —$SR^3$, is further substituted or unsubstituted.

8. A photographic element according to claim 7 wherein $Z_2$ the atoms necessary to complete a substituted or unsubstituted benzothiazole nucleus.

9. A photographic element according to claim 1 wherein $Z_2$ represents a substituted or unsubstituted: thiazole nucleus, thiazoline nucleus, oxazole nucleus, selenazole nucleus, quinoline nucleus, tellurazole nucleus, imidazole nucleus, or pyridine nucleus.

10. A Photographic element according to claim 1 wherein the dye has the formula:

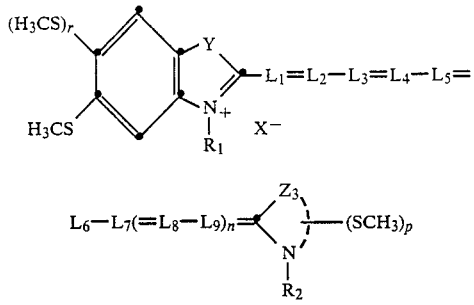

wherein p is 0, 1, or 2, r is 0 or 1,

Y represents S, 0 or Se, $Z_3$ represents the atoms necessary to complete a benzothiazole nucleus benzoxazole nucleus, benzotellurazole nucleus, or benzoselenazole nucleus if p is 1 or 2, and which may be further substituted if p is 1, or the atoms necessary to complete a substituted or unsubstituted: thiazole nucleus, thiazoline nucleus, oxazole nucleus, selenazole nucleus, quinoline nucleus, tellurazole nucleus, or pyridine nucleus if p is 0.

11. A photographic element according to claim 10 wherein Y is S.

12. A photographic element according to claim 11 wherein $Z_3$ represents the atoms necessary to complete a substituted or unsubstituted benzothiazole nucleus, and p-is 1 or 2.

13. A photographic element according to claim 10 wherein n is 0.

14. A photographic element according to claims 10 or 13 wherein r is 1.

* * * * *